US006155055A

United States Patent [19]

Forestier

[11] Patent Number: 6,155,055

[45] Date of Patent: Dec. 5, 2000

[54] SEPARATOR FOR A TWO-HEAD COMBUSTOR CHAMBER

[75] Inventor: Alexandre Forestier, Boissise la Bertrand, France

[73] Assignee: Societe Nationale d'Etude et de Construction de Moteurs d'Aviation, France

[21] Appl. No.: 09/291,276

[22] Filed: Apr. 14, 1999

[30] Foreign Application Priority Data

Apr. 16, 1998 [FR] France ..... 98 04704

[51] Int. Cl.[7] ..... F23R 3/16

[52] U.S. Cl. ..... 60/747; 60/753

[58] Field of Search ..... 60/747, 752, 753, 60/756

[56] References Cited

U.S. PATENT DOCUMENTS

| | | | |
|---|---|---|---|
| 5,220,795 | 6/1993 | Dodds et al. | 60/747 |
| 5,285,632 | 2/1994 | Halila | 60/753 |
| 5,417,069 | 5/1995 | Alary et al. | 60/747 |
| 5,421,158 | 6/1995 | Stenger et al. . | |
| 5,970,716 | 10/1999 | Forrester et al. | 60/747 |

FOREIGN PATENT DOCUMENTS

| | | |
|---|---|---|
| 0 564 170 | 10/1993 | European Pat. Off. . |
| 2 297 830 | 8/1996 | United Kingdom . |

*Primary Examiner*—Louis J. Casaregola
*Attorney, Agent, or Firm*—Bacon & Thomas PLLC

[57] ABSTRACT

A separator (10) for a two-head combustion chamber which comprises a plurality of segments (11) that are arrayed circumferentially and spaced apart a distance (x) from one another and that are affixed to appropriately shaped sheet-metal (12, 13) of the combustion chamber. Each segment (11) is shaped as an elongated, hollow body with an upper wall (17) and a lower wall (18). The segments are cooled by air from an upstream portion of an end of the combustion chamber entering the segments (11) and exhausting by a plurality of orifices (34) in the segment walls (17, 18). The upper and lower segment walls (17) and (18) are respectively heat-protected by two sets of tiles (40, 41), each of the tiles straddling two adjacent segments, being spaced a distance from the walls (17, 18) to subtend an enclosed space (46, 47) therebetween, and having at least one tile orifice (48, 49, 50) which allows the cooling air from the segments (11) to exhaust into the heads.

18 Claims, 1 Drawing Sheet

SEPARATOR FOR A TWO-HEAD COMBUSTOR CHAMBER

BACKGROUND OF THE INVENTION

1. Field of the Invention

The present invention relates to a separator for a two-head combustion chamber of a gas-turbine engine. More particularly, it relates to a separator which is heat protected and prevents recirculation of gases between the heads.

2. Description of the Related Art

Designing new aeronautic gas-turbine engines for low pollution has led to the development of annular, two-head combustion chambers. One head, the so-called master head, operates in the low and full power modes. The other head, called the takeoff head, operates only in the full powel mode.

With respect to the total combustion chamber volume, the two heads are bounded at an end of the chamber by a ring, called the separator, thus forming two concentric hoops.

The separator is a critical component in combustion-chamber design because it is subjected to longitudinal and tangential stresses during engine operation.

In order to eliminate these stresses, the separator ring consists of a plurality of mutually spaced, circumferentially arrayed segments.

Each segment is cooled by moving air through the segments and exhausting the cooling air through a plurality of wall orifices into the heads.

Outer walls of the separator are subjected to very high temperatures during engine operation. Furthermore, the circumferential intersections of the separators encourage recirculating hot gases between the two heads.

SUMMARY OF THE INVENTION

The objective of the invention is to provide heat protection of the outer segment walls and to prevent gases from recirculating between the two heads.

Accordingly, the invention is for an annular combustion chamber comprising two concentric, radially mutually offset heads which are bounded at an end of the combustion chamber by a gas-separating ring. The gas-separating or separator ring comprises a plurality of segment elements, hereafter segments, which are circumferentially arrayed and mutually spaced apart. Each of the segments is affixed to sheetmetal of the chamber and is shaped as a hollow body with upper arid lower walls. Each of the segments is cooled by moving air from an upstream zone of the end of the combustion chamber through the segment and exhausting the cooling air through a plurality of orifices in the segment walls.

According to the invention, the segments are thermally protected by two sets of tiles covering the upper and lower walls of the segments, respectively. The tiles are arranged to straddle two adjacent segments while being spaced apart from the walls to subtend spaces in which the cooling air may move. The tiles are each fitted with orifices for exhausting the cooling air into the two heads.

The following advantageous design features are furthermore included:

- each segment is fitted at its downstream end with a downstream channel and, in the vicinity of the upstream ends of the upper and lower walls, with external ribs which, together with the sheetmetal of the combustion-chamber end, bound inner/outer channels;
- each tile is fitted with a hook flange at its downstream end and with an internal rib at its upstream end, the hook flange and rib being received in the downstream channel and the inner/outer channel, respectively;
- the upstream tile ends are secured between the segment walls and the appropriately shaped sheetmetal;
- the segment ribs comprise hollows which are engaged by projections on inside surfaces of the tiles for the purpose of circumferentially keeping the tiles in place relative to the segments;
- a play is provided between the tile hook flanges and the downstream channels to allow axial displacement of the segments;
- a coat of zirconate is deposited on the tiles to form a heat barrier.

BRIEF DESCRIPTION OF THE DRAWINGS

Other advantages and features of the invention are elucidated in the following, illustrative description of a preferred embodiment, with reference to the attached drawings, in which.

DETAILED DESCRIPTION OF THE PREFERRED EMBODIMENT

Figure 1:
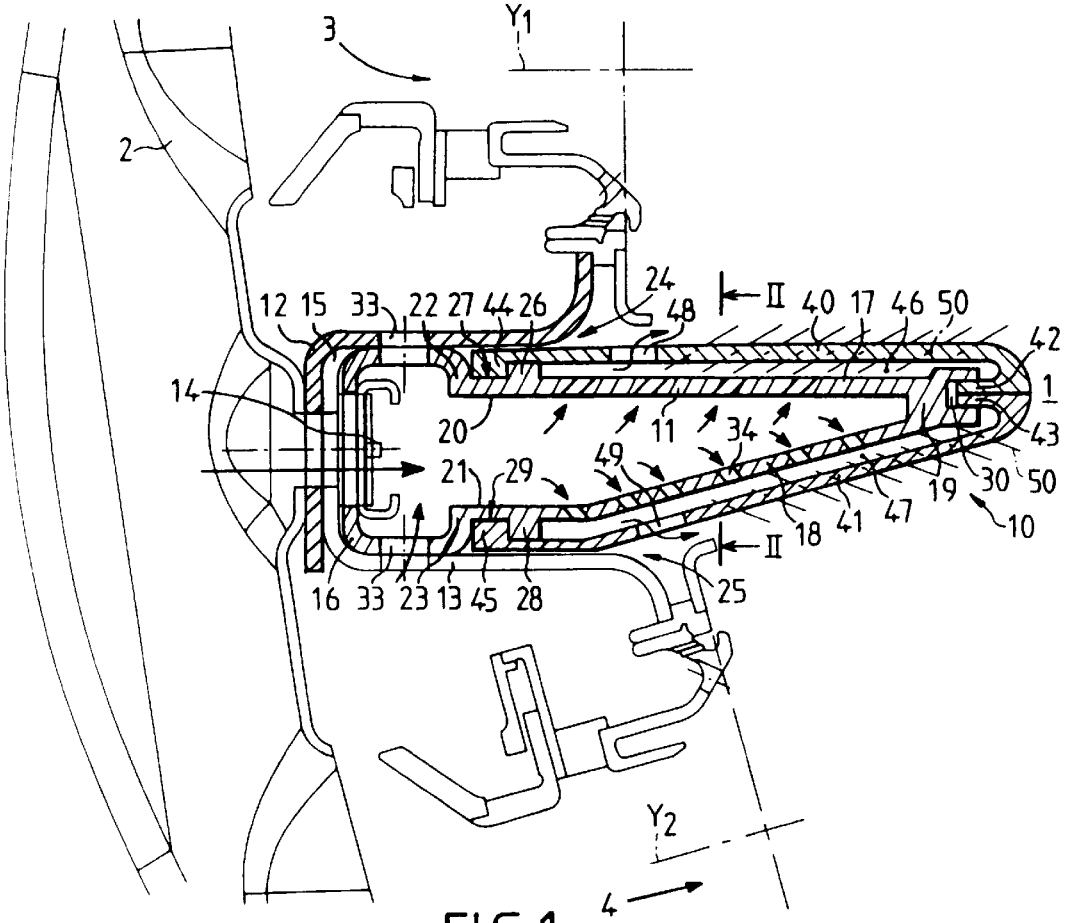
FIG. 1 is an axial half-section view of a middle part of an end of a two-head combustion chamber which is fitted with a separator according to the invention.

FIG. 1 shows a combustion enclosure 1 of a gas-turbine engine's two-head combustion chamber which is bounded by an annular outer wall and an annular inner wall, which are bodies of revolution symmetrical about a common axis. Furthermore, a combustion-chamber end 2 connecting the downstream ends of the two annular walls is partly shown in FIG. 1.

The combustion-chamber end 2 is equipped with two sets of fuel injectors arrayed on annular collars of different diameters.

The injectors of the outer set pass through holes 3 along axes Y1 in the combustion-chamber end 2 and, for fuel carburetion, cooperate with air passages crossing the combustion-chamber end 2 and the walls of the enclosure 1. These fuel injectors are closest to the outer wall, are designed to operate alone at low power, and constitute fuel injectors for the master head.

The injectors of the inner set pass through holes 4 along axes Y2 in the combustion-chamber end 2. These fuel injectors operate only in the full power takeoff mode of the gas-turbine engine.

A generally annular gas-separating assembly 10 affixed to the combustion-chamber end 2 is interposed between the two sets of injectors. This separator assembly or separator ring 10 extends inside the combustion enclosure 1 from the combustion-chamber end 2.

As shown in the drawings, the gas-separator assembly 10 comprises a plurality of hollow, elongated segments 11 which are circumferentially arrayed and spaced a given distance x apart from each other. Each segment 11 is affixed to appropriately shaped sheetmetal 12, 13 of the combustion-chamber end 2 by a fastener (distinct from those of the other segments).

For that purpose, the sheetmetal 12, 13 of the corn bustion-chamber end 2 are shaped to form, at the side of the combustion enclosure 1, an annular channel 15 with a U cross-section (rotated by 90°). Upstream portions 16 of each segment 11 engage the channel 15.

Each segment 11 comprises an upper wall 17 and a lower wall 18 which are linked at a downstream end 19 so as to form a wedge in the combustion enclosure 1. Upstream ends 20 and 21 of each segment are connected to the upstream portions 16 by connecting walls 22 and 23 constituting offsets such that the upstream portions 16 of the upper and lower walls 17, 18 are spaced away from the sheetmetal 12, 13 so as to bound annular spaces 24, 25.

In the annular space 24, the upper wall 17 comprises an external rib 26 parallel to the connecting wall 22. Together with the connecting wall 22 and the sheetmetal 12, the external rib 26 subtends an upper channel 27.

Similarly, the lower wall 18 is fitted inside the annular space 25 with an external rib 28 parallel to the connecting wall 23. Together with the connecting wall 23 and the sheetmetal 13, the external rib 28 subtends a lower channel 29.

The downstream end 19 of the upper and lower walls 17, 18 is fitted with a downstream channel 30 opening in the opposite direction of the end 2 of the combustion chamber.

Figure 2:
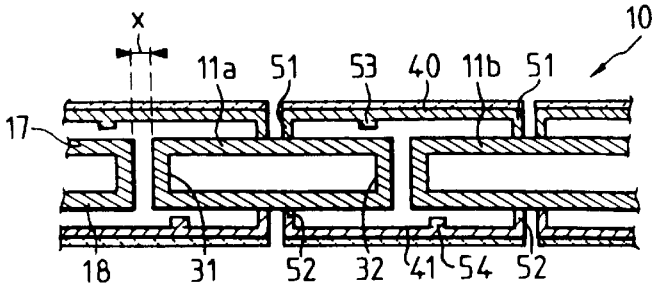
FIG. 2 is a slightly smaller scale geometric representation of a cross-section of the separator taken along line II—II of FIG. 1.

As shown in FIG. 2, two side walls 31, 32 seal the circumferential ends of each segment 11 by connecting the upper and lower walls 17, 18.

The upstream portions 16 of each segment 11 and the sheetmetal 12, 13 of the combustion-chamber end 2 comprise upstream holes 33 to tap cooling air upstream of the combustion-chamber end 2. The cooling air moves inside each segment 11 and is exhausted through a plurality of wall orifices 34 in the upper and lower walls 17 and 18.

The upper walls 17 of the segments 11 are heat-protected by a first set of tiles 40, each of which straddles two adjacent tiles 11*a,* 11*b* as shown in FIG. 2.

In the same manner, the lower walls 18 of the segments 11 are heat protected by a second set of tiles 42.

Each tile 40, 41 includes a downstream end with a hook flange 42, 43 extending toward the combustion-chamber end 2. The hook flanges 42, 43 of two tiles 40, 41 straddle the same segments 11*a,* 11*b* and are designed to be seated, mounted one on the other, with play in the downstream channels 30 of the two segments 11*a,* 11*b*.

Furthermore, each tile 40, 41 includes an upstream end with a rib 44, 45 situated on its inside surface and designed to embed in the channel 27, 29 at the end of the annular channel 24, 25.

The heights of the ribs 26 and 44, 28 and 45 and the wall thicknesses of the tiles 40 and 41 are determined such that the upstream ends of the tiles 40 and 41 are secured between the sheetmetal 12, 13 and the segments 11.

Moreover, the inside surfaces of the tiles 40, 41 are kept spaced apart from the outer and lower walls 17 and 18 by a distance substantially equal to the thickness of the external ribs 26, 28 to subtend enclosed spaces 46, 47 which allow the cooling air exhausted through the wall orifices 34 to move therethrough. The cooling air is then exhausted through tile orifices 48, 49 in the tiles 40, 41 and through multiple perforations 50 in the thickness of the tiles 40, 41. The spaces 46, 47 are circumferentially sealed by tile flanges 51, 52 resting against outer surfaces of the upper and lower walls 17, 18 of the adjacent segments 11*a,* 11*b*.

A coat of zirconate is applied to the tiles 40, 41 to form a heat barrier.

The tiles 40, 41 are circumferentially kept in place relative to the segments 11 by bosses 53, 54 integral with the inner surfaces of the tiles 40, 41 which engage hollows (not shown) fitted with the external ribs 26, 28 of the segments 11.

The tiles 40, 41 are assembled as follows:

The separator segments 11 are circumferentially mounted on an assembly tool;

Thereupon the tiles 40, 41 are oriented axially so as to engage the hook flanges 42, 43 with the downstream channel 30 of the segments 11 and the bosses 53, 54 with the hollows of the external ribs 26, 28 of the segments 11. The ribs 44, 45 of the tiles 40, 41 then elastically embed into he channels 27, 29 of the segments 11.

The upstream portions 16 are then embedded into the annular channel 15 of the combustion-chamber end 2 subtended by the sheetmetal 12, 13, wherein it is affixed by fasteners 14.

The presence of the tiles 40, 41 on the segments 11 of the gas separator improves the cooling efficiency of the gas separator. By straddling two adjacent segments, the tiles 40, 41 seal the segments 11 against gases flowing between the segments 11 and recirculating between the two heads.

I claim:

1. A separator ring (10) for an annular combustion chamber comprising two mutually radially offset concentric heads, which are partitioned in an end (2) of the combustion chamber, and appropriately shaped sheetmetal (12, 13), the separator ring (10) comprising:

a plurality of segments 11) arrayed circumferentially and spaced apart a given distance (x) from each other, each of the segments (11) being affixed on the appropriately shaped sheetmetal (12, 13) of the combustion chamber, each of the segments (11) being shaped as an elongated, hollow body with an upper wall (17) and a lower wall (18), the upper and lower walls (17, 18) having a plurality of wall orifices (34) formed therein to exhaust cooling air entering the segments (11) from an upstream side of the combustion chamber end (2);

a first set of tiles (40) covering the upper walls (17) of the segments (11); and a second set of tiles (41) covering the lower walls (18) of the segments (11);

wherein each of the tiles (40, 41) straddles adjacent segments (11), is spaced a distance from the respective wall (17, 18) to subtend an enclosed space (46, 47) therebetween, and has at least one tile orifice (48, 49, 50) which allows the cooling air from the segments (11) to exhaust into the heads.

2. A separator ring (10) according to claim 1, further comprising:

a downstream end of each segment (11) having a downstream channel (30);

an upstream end of both the upper and lower walls (17, 18) of each segment (11) having an external rib (26, 28) which subtends an upper/lower channel (27, 29) with the sheetmetal (12, 13) of the combustion chamber;

a downstream end of each tile (40, 41) having a hook flange (42, 43); and an upstream end of each tile (40, 41) having an internal rib (44, 45);

wherein the hook flanges (42, 43) are received by the downstream channels (30) and the internal ribs (44, 45) are received by the upper/low channels (27, 29).

3. A separator ring (10) according to claim 2, wherein the upstream ends of the tiles (40, 41) are secured between the sheetmetal (12, 13) of the combustion chamber and the upper and lower walls (17, 18) of the segments (11).

4. A separator ring (10) according to claim 2, further comprising:

at least one boss (53, 54) formed on an inner surface of each of the tiles (40, 41);

wherein the external ribs (26, 28) of the segments comprise recesses which engage the bosses (53, 54) of the tiles (40, 41).

5. A separator ring (10) according to claim 3, further comprising:

at least one boss (53, 54) formed on an inner surface of each of the tiles (40, 41);

wherein the external ribs (26, 28) of the segments comprise recesses which engage the bosses (53, 54) of the tiles (40, 41).

6. A separator ring (10) according to claim 2, wherein the hook flanges (42, 43) are received by the downstream channels with a desired play.

7. A separator ring (10) according to claim 3, wherein the hook flanges (42, 43) are received by the downstream channels with a desired play.

8. A separator ring (10) according to claim 4, wherein the hook flanges (42, 43) are received by the downstream channels with a desired play.

9. A separator ring (10) according to claim 5, wherein the hook flanges (42, 43) are received by the downstream channels with a desired play.

10. A separator ring (10) according to claim 1, wherein the tiles (40, 41) are covered with a coat of zirconate.

11. A separator ring (10) according to claim 2, wherein the tiles (40, 41) are covered with a coat of zirconate.

12. A separator ring (10) according to claim 3, wherein the tiles (40, 41) are covered with a coat of zirconate.

13. A separator ring (10) according to claim 4, wherein the tiles (40, 41) are covered with a coat of zirconate.

14. A separator ring (10) according to claim 5, wherein the tiles (40, 41) are covered with a coat of zirconate.

15. A separator ring (10) according to claim 6, wherein the tiles (40, 41) are covered with a coat of zirconate.

16. A separator ring (10) according to claim 7, wherein the tiles (40, 41) are covered with a coat of zirconate.

17. A separator ring (10) according to claim 8, wherein the tiles (40, 41) are covered with a coat of zirconate.

18. A separator ring (10) according to claim 9, wherein the tiles (40, 41) are covered with a coat of zirconate.

* * * * *

UNITED STATES PATENT AND TRADEMARK OFFICE

CERTIFICATE OF CORRECTION

PATENT NO. : 6,155,055
DATED : December 5, 2000
INVENTOR(S) : Forestier

It is certified that error appears in the above-identified patent and that said Letters Patent is hereby corrected as shown below:

Column 1,
Line 46, “arid” should read -- and --.

Column 4,
Line 65, “low” should read -- lower --.

Signed and Sealed this

Twenty-ninth Day of October, 2002

*Attest:*

*Attesting Officer*

JAMES E. ROGAN
*Director of the United States Patent and Trademark Office*